US009833676B2

(12) United States Patent
Smith, Jr.

(10) Patent No.: US 9,833,676 B2
(45) Date of Patent: Dec. 5, 2017

(54) BASEBALL AND SOFTBALL PITCHING TRAINING AID

(71) Applicant: Robert Frank Smith, Jr., Glen Allen, VA (US)

(72) Inventor: Robert Frank Smith, Jr., Glen Allen, VA (US)

( * ) Notice: Subject to any disclaimer, the term of this patent is extended or adjusted under 35 U.S.C. 154(b) by 0 days.

(21) Appl. No.: 15/003,040

(22) Filed: Jan. 21, 2016

(65) Prior Publication Data

US 2016/0206942 A1 Jul. 21, 2016

Related U.S. Application Data

(60) Provisional application No. 62/106,147, filed on Jan. 21, 2015.

(51) Int. Cl.
*A63B 69/00* (2006.01)
*A63B 43/00* (2006.01)

(52) U.S. Cl.
CPC ..... *A63B 69/0002* (2013.01); *A63B 43/007* (2013.01); *A63B 2069/0006* (2013.01); *A63B 2220/30* (2013.01); *A63B 2220/35* (2013.01); *A63B 2225/093* (2013.01); *A63B 2225/50* (2013.01)

(58) Field of Classification Search
CPC ..... A63B 69/0002; A63B 15/005; A63B 2069/0006; A63B 2069/0008; A63B 2220/36
USPC ..... 473/428, 457, 451, 423–425; 700/91
See application file for complete search history.

(56) References Cited

U.S. PATENT DOCUMENTS 3,136,546 A * 6/1964 Connolly ..... A63B 15/005 446/421
3,578,801 A * 5/1971 Piazza ..... A63B 59/50 473/457
4,027,886 A * 6/1977 Katsube ..... A63B 69/3632 273/456
4,634,121 A * 1/1987 Sasaki ..... A63B 15/00 473/457
5,360,209 A * 11/1994 Mollica ..... A63B 15/005 473/457
7,297,077 B1 * 11/2007 Battaglino ..... A63B 59/00 473/422
7,297,078 B2 * 11/2007 Libonati ..... A63B 15/005 473/422
8,118,693 B2 * 2/2012 Tande ..... A63B 15/005 473/422

(Continued)

*Primary Examiner* — Mark Graham
(74) *Attorney, Agent, or Firm* — Dunlap Bennett & Ludwig PLLC

(57) ABSTRACT

A pitching training aid is provided. The pitching training aid includes an elongated poll having a first end, a second end, and a common axis running from the first end to the second end. The present invention further includes a ball having a slot running from a first side to a second side opposite the first side along a center of the ball. The slot is sized to fit around the elongated poll so that the ball slidably engages the elongated poll along the common center axis. A first stopper is secured to the first end of the elongated poll and a second stopper is secured to the second end of the elongated poll. The first stopper and the second stopper have a diameter greater than a diameter of the elongated poll, thereby preventing the ball from sliding off of the elongated poll.

10 Claims, 4 Drawing Sheets

(56) References Cited

U.S. PATENT DOCUMENTS

| | | | | |
|---|---|---|---|---|
| 8,540,584 | B1 * | 9/2013 | Sorenson | A63B 69/36 473/219 |
| 2004/0048696 | A1 * | 3/2004 | Ciesar | A63B 69/0002 473/457 |
| 2005/0153797 | A1 * | 7/2005 | Nutter | A63B 15/005 473/457 |
| 2010/0234144 | A1 * | 9/2010 | Sutlovich | A63B 69/0002 473/457 |
| 2012/0238382 | A1 * | 9/2012 | Allison | A63B 67/10 473/428 |
| 2012/0244969 | A1 * | 9/2012 | Binder | A63H 33/18 473/570 |
| 2014/0135959 | A1 * | 5/2014 | Thurman | A63B 69/002 700/91 |
| 2015/0157911 | A1 * | 6/2015 | Palardis | A63B 69/0002 473/428 |

* cited by examiner

BASEBALL AND SOFTBALL PITCHING TRAINING AID

CROSS-REFERENCE TO RELATED APPLICATION

This application claims the benefit of priority of U.S. provisional application No. 62/106,147, filed Jan. 21, 2015, the contents of which are herein incorporated by reference.

BACKGROUND OF THE INVENTION

The present invention relates to a training aid and, more particularly, to a baseball pitching training aid.

In baseball and softball, the pitcher is the player who throws a ball from the pitcher's mound toward the catcher to begin each play. Currently, players have a difficult time learning how to rotate a baseball or softball when throwing a pitch.

As can be seen, there is a need for a pitching training aid for softball or baseball.

SUMMARY OF THE INVENTION

In one aspect of the present invention, a pitching training aid comprises: an elongated poll comprising a first end and a second end and having a common center axis; a ball comprising a slot running from a first side to a second side opposite the first side along a center of the ball; and a first stopper secured to the first end of the elongated poll and a second stopper secured to the second end of the elongated poll, each of the first stopper and the second stopper comprising a diameter greater than a diameter of the elongated poll, wherein the slot is sized to fit around the elongated poll so that the ball slidably engages the elongated poll along the common center axis.

These and other features, aspects and advantages of the present invention will become better understood with reference to the following drawings, description and claims.

DETAILED DESCRIPTION OF THE INVENTION

Figure 1:
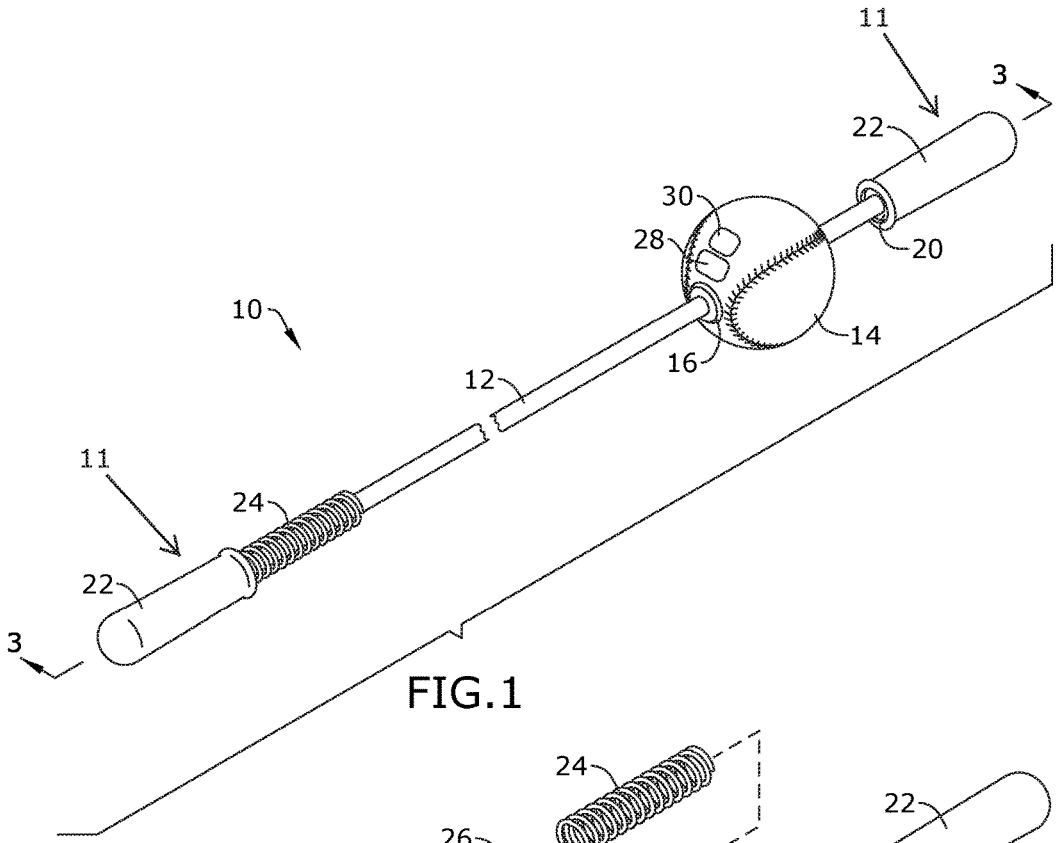
FIG. 1 is a perspective view of an embodiment of the present invention.
Figure 2:
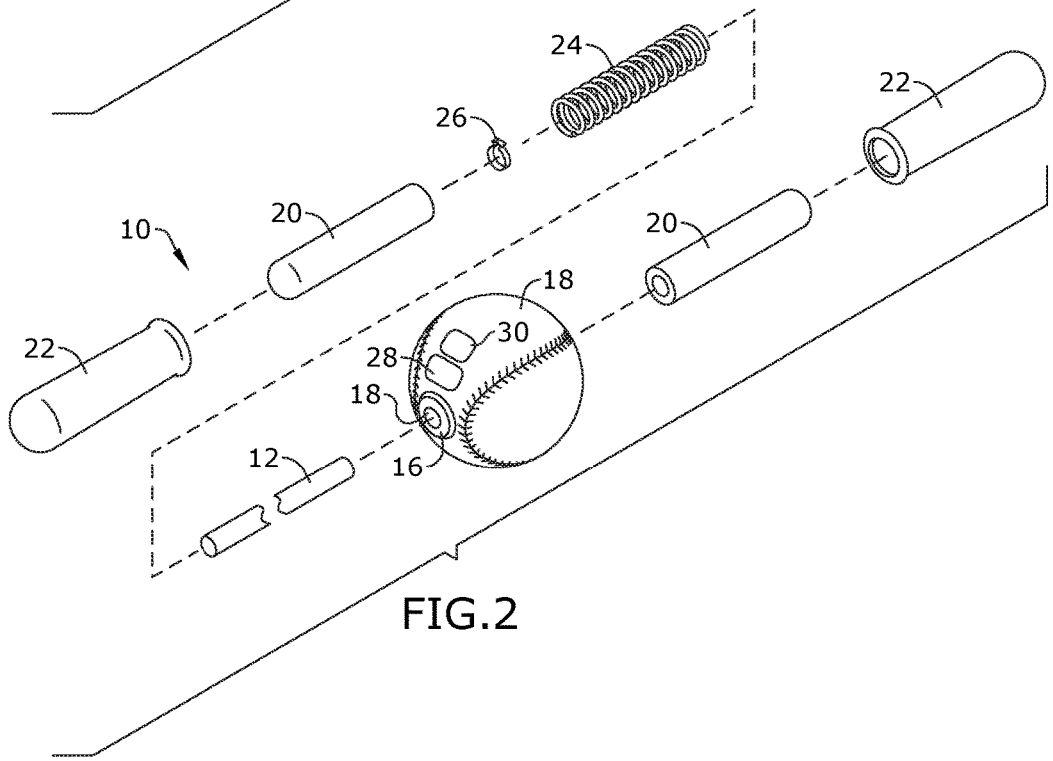
FIG. 2 is an exploded view of an embodiment of the present invention.
Figure 3:
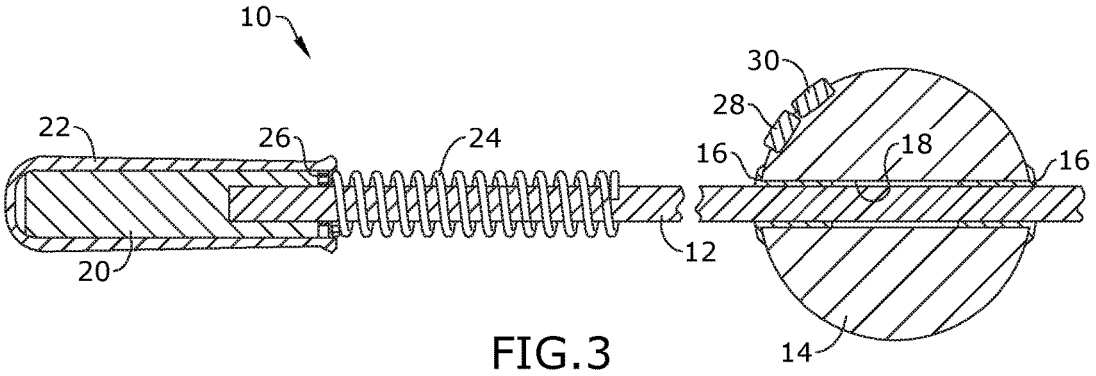
FIG. 3 is a section view of the present invention, taken along line 3-3 in FIG. 1.
Figure 4:
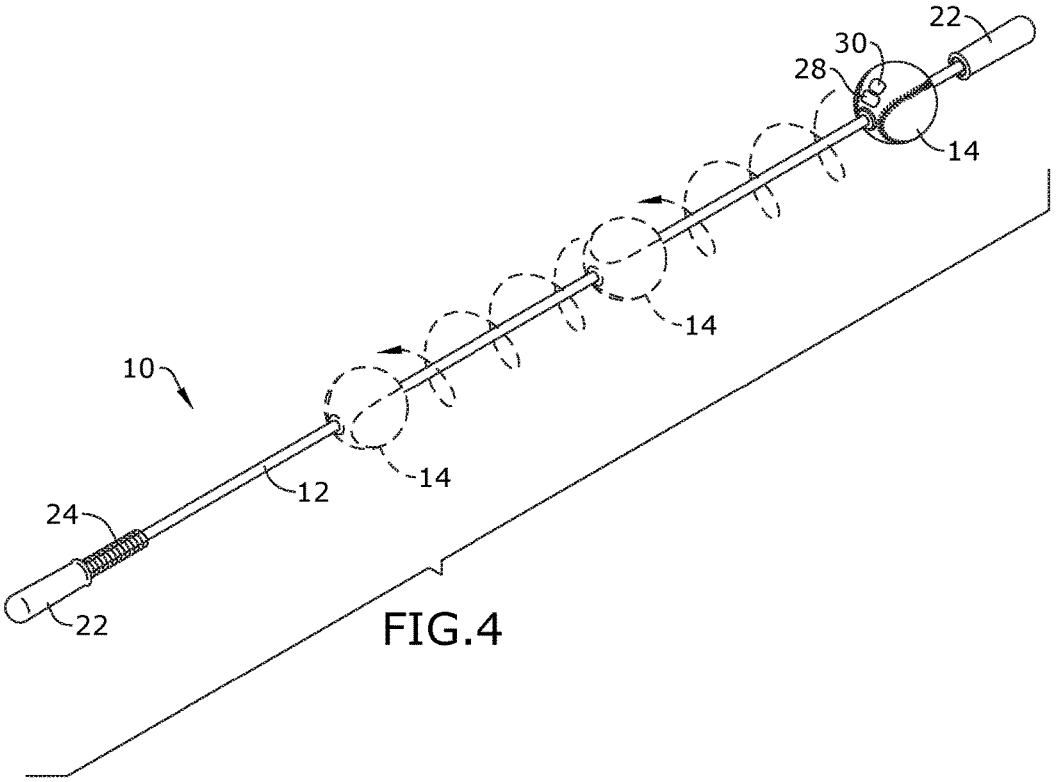
FIG. 4 is a perspective view of an embodiment of the present invention illustrating the travel of the ball when pitched.
Figure 5:
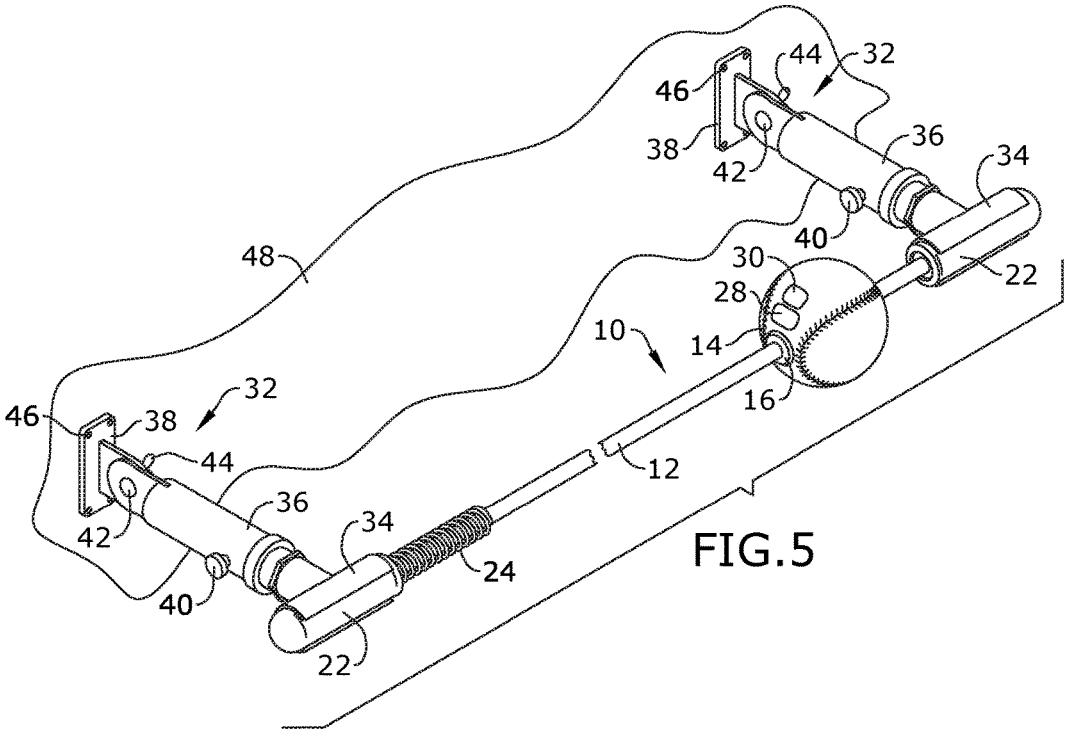
FIG. 5 is a perspective view of an embodiment of the present invention shown in use with a wall mount.
Figure 6:
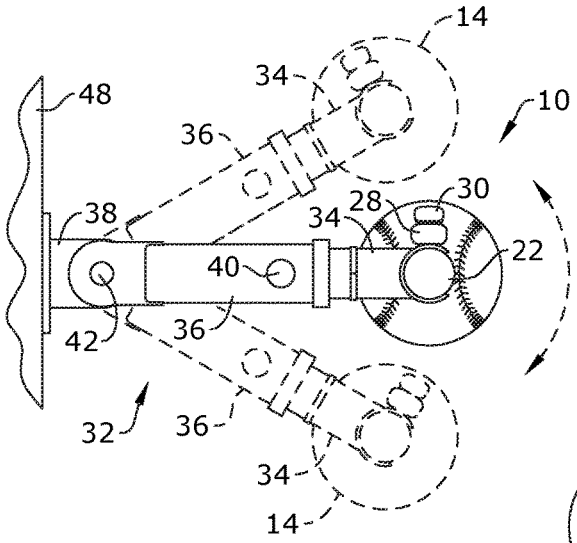
FIG. 6 is a side view of an embodiment of the present invention illustrating the height adjustment of the wall mount.
Figure 7:
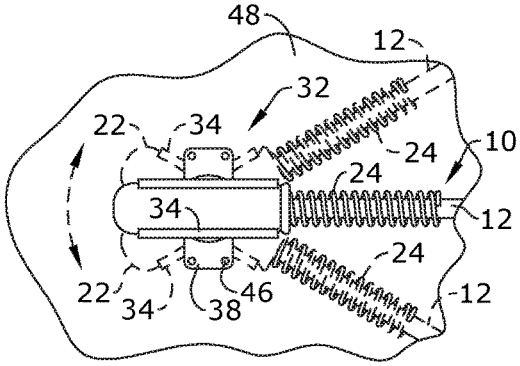
FIG. 7 is a front view of an embodiment of the present invention illustrating the slope adjustment of the wall mount.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, the present invention includes an elongated pole and a ball that slidably engages the elongated pole. The present invention allows a user to see and feel the proper arm action and rotation that should be used then throwing or pitching. For example, the user sees the ball rotating down the line of the stick and also feels how the ball comes off his/her hand to rotate the ball properly. Acquiring the correct feeling of a pitch with the proper rotation is important in the success of playing baseball and softball.

Referring to FIGS. 1 through 9, the present invention includes a pitching training aid 10. The pitching training aid 10 includes an elongated pole 12 having a first end, a second end, and a common axis running from the first end to the second end. The present invention further includes a ball 14 having a slot 18 running from a first side to a second side opposite the first side along a center of the ball 14. The slot 18 is sized to fit around the elongated pole 12 so that the ball 14 slidably engages the elongated pole 12 along the common center axis. A first stopper 11 is secured to the first end of the elongated pole 12 and a second stopper 11 is secured to the second end of the elongated pole 12. The first stopper 11 and the second stopper 11 have a diameter greater than a diameter of the elongated pole 12 and the slot 18, thereby preventing the ball 14 from sliding off of the elongated pole 12.

The ball 14 of the present invention is able to slide from the first stopper 11 to the second stopper 11 of the elongated pole 12. In certain embodiments, the pole 12 may be made of a low friction material, such as a smooth metal or plastic. Further, the present invention may include a low friction insert 16 secured to the ball 14 within the slot 18. The low friction insert 16 may also be made of a low friction material, such as a smooth metal or plastic. An inside surface of the low friction insert 16 may contour with an outside surface of the pole 12. For example, the outside surface of the pole 12 may be rounded and the inside surface of the low friction insert 16 may be rounded. A user may thereby easily throw the ball 14 from the first stopper 11 to the second stopper 11.

The present invention may further include at least one spring 24. For example, the spring 24 may be a compression spring wrapped around the elongated pole 12. In certain embodiments, the spring 24 may be secured to the first end of the elongated pole 12 by a pinch clamp 26. In certain embodiments, a spring 24 may be secured to the first end and the second end of the elongated pole 12. A user may thereby slide the ball 14 from the second end to the first end and the spring 24 may compress and launch the ball back to the second end. A user may thereby continuously train using the pitching training aid 10 without pause.

In certain embodiments, the stoppers 11 may be in the form of handles 20. For example, the first stopper 11 may include a first handle 20 and the second stopper may include a second handle 20. The handles 20 allow a user to hold onto and support the pitching training aid 10 in an elevated position. In such embodiments, rubber grips 22 may be secured over the first handle 20 and the second handle 20.

The present invention may further include a wall mount 32 for supporting the pitching training aid 10 in an elevated position. The wall mount 32 may include a first bracket 38 and a second bracket 38. A first post 36 may extend from the first bracket 38 and a second post 36 may extend from the second bracket 38. A first clip 34 may be secured to the first post 36 and a second clip 34 may be secured to the second post 36. Each of the brackets 38 may include apertures. Bolts 46 may run through the apertures and into a wall 48 or other surface, thereby securing the brackets 38 to the wall 48. The first stopper 11 releasably retains to the first clip 34 and the second stopper 11 releasably retains to the second clip 34, thereby mounting the elongated pole 12 to the wall 48.

In certain embodiments, the posts 36 may pivot relative to the brackets 38 to adjust a height of the elongated pole 12. A first pivot pin 42 and wing nut 44 pivotally secure the first post 36 to the first bracket 38 and a second pivot pin 42 and wing nut 44 pivotally secure the second post 36 to the second bracket 38. By loosening the wing nuts 44, a user may pivot the first and second posts 36 about a center axis of the pivot pins 42. By tightening the wing nuts 44, the posts 36 are fixed to the adjusted height.

Figure 8:
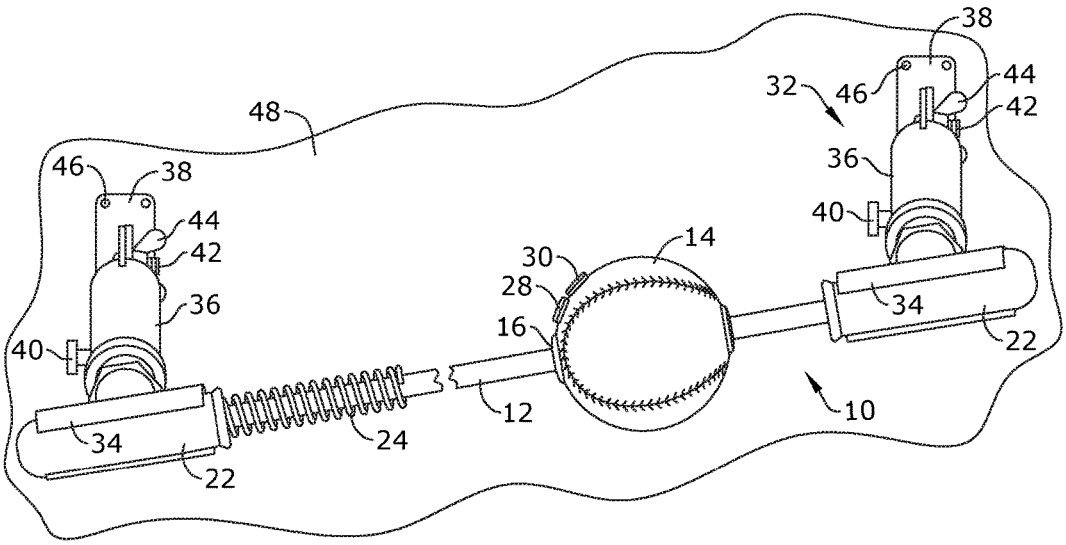
FIG. 8 is a front view of an embodiment of the present invention with the wall mount adjusted for height and slope.
Figure 9:
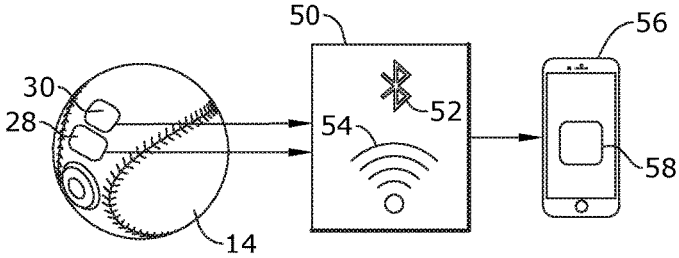
FIG. 9 is a schematic view of an embodiment of the present invention showing a connection between sensors of the ball and a computer.

In certain embodiments, the clips 34 are rotatable about a center axis of the posts 36 to adjust a slope of the elongated pole 12. In such embodiments, the posts 36 may include a hollow center and the clips 34 may include a tube running into the hollow center. A set screw 40 may run through each of the posts 36 and press against the tube of the clips 34. In such embodiments, a user may loosen the set screw 40 and rotate the clip 34. The user may then tighten the set screw 40 to set the clip 34 in a fixed position. As illustrated in FIG. 8, the brackets 46 may be secured to different heights of the wall 48, thereby providing an adjustable slope.

In certain embodiments, the present invention may provide data feedback. In such embodiments, a speed sensor 28 and a cadence (rotation) sensor 30 may be secured to the ball 14. The speed sensor 28 detects how fast the ball is moving and the cadence sensor 30 detects rotations per amount of time, such as rotations per minute, of the ball 14. The ball 14 may further include a wireless transmitter 50, such as Bluetooth ® technology 52 or a network connection 54. The present invention may further include a computer 56 with a display 58. The computer 56 may be a desktop, laptop, or smart device, such as a smart phone or tablet. The computer 56 includes a wireless receiver operable to receive the data from the wireless transmitter 50 including the speed and rotations per minute of the ball 14. The display 58 then displays the data to the user.

The present invention allows the player more repetitions with less stress on the arm and elbow. The proper throwing mechanics are key to all good pitchers and throwers. When the elongated pole is mounted to a wall, a user throws the ball down the line of the elongated pole, thereby improving arm action and proper rotation. When using the elongated pole off the wall, a user may place one end of the elongated pole against the wall with some pressure. The user holds the handle above their head to the required height and uses the throwing hand to throw the ball along the elongated pole. The user is able to the view the rotation of the ball.

The spring returns the ball back to the user after each throw. When using the present invention with a softball, the user may go through their pitching motion throwing underhand and spinning or rotating the ball for inside or outside rotation. When using a shorter length stick, the user can sit on the bench or in the bullpen working on hand action and rotation.

It should be understood, of course, that the foregoing relates to exemplary embodiments of the invention and that modifications may be made without departing from the spirit and scope of the invention as set forth in the following claims.

What is claimed is:

1. A pitching training aid comprising:

an elongated pole comprising a first end and a second end and having a common center axis;

a ball comprising a slot running from a first side to a second side opposite the first side, wherein the slot is sized to fit around the elongated pole so that the ball slidably engages the elongated pole along the common center axis;

a first stopper secured to the first end of the elongated pole and a second stopper secured to the second end of the elongated pole, each of the first stopper and the second stopper comprising a diameter greater than a diameter of the elongated pole; and a wall mount comprising a first bracket comprising a first clip, a second bracket comprising a second clip, wherein the first bracket and the second bracket are mountable to a surface, and the first stopper releasably retains to the first clip and the second stopper releasably retains to the second clip.

2. The pitching training aid of claim 1, further comprising at least one spring secured around the elongated pole and disposed at the first end.

3. The pitching training aid of claim 1, wherein the first stopper comprises a first handle and the second stopper comprises a second handle.

4. The pitching training aid of claim 3, wherein a first rubber grip is secured over the first handle and a second rubber grip is secured over the second handle.

5. The pitching training aid of claim 1, further comprising a speed sensor and a cadence sensor within the ball.

6. The pitching training aid of claim 5, further comprising:

a wireless transmitter secured within the ball and operable to send data from the speed sensor and the cadence sensor;

a computer comprising a display and a wireless receiver operable to receive the data from the wireless transmitter, wherein the display is operable to display the data.

7. The pitching training aid of claim 1, further comprising a first post extending from the first bracket, and a second post extending from the second bracket, wherein the first clip is secured to the first post; and the second clip is secured to the second post.

8. The pitching training aid of claim 7, further comprising a first pivot pin pivotally securing the first post to the first bracket and a second pivot pin pivotally securing the second post to the second bracket, wherein the first post is pivotable about a center axis of the first pivot pin and the second post is pivotable about a center axis of the first pivot pin.

9. The pitching training aid of claim 7, wherein the first clip is rotatable about a center axis of the first post and the second clip is rotatable about a center axis of the second post.

10. The pitching training aid of claim 1, further comprising at least one low friction insert disposed within the slot.

* * * * *